US008359665B2

(12) United States Patent
Bruce

(10) Patent No.: US 8,359,665 B2
(45) Date of Patent: Jan. 29, 2013

(54) EMERGENCY ANTI-HYPOTHERMIA SYSTEM AND HIGHLY PORTABLE, INFLATABLE EMERGENCY VEST THEREFOR

(75) Inventor: Ian A. Bruce, Laguna Niguel, CA (US)

(73) Assignee: Solatec LLC, New York, NY (US)

( * ) Notice: Subject to any disclaimer, the term of this patent is extended or adjusted under 35 U.S.C. 154(b) by 363 days.

(21) Appl. No.: 11/068,267

(22) Filed: Feb. 28, 2005

(65) Prior Publication Data

US 2005/0278823 A1 Dec. 22, 2005

Related U.S. Application Data

(60) Provisional application No. 60/547,918, filed on Feb. 26, 2004.

(51) Int. Cl.
*A41D 13/00* (2006.01)

(52) U.S. Cl. ..... 2/102

(58) Field of Classification Search ..... 2/455, 456, 2/102, 69, 69.5, 108, 2.15, 82, 59, DIG. 3; 441/102, 103, 106–108
See application file for complete search history.

(56) References Cited

U.S. PATENT DOCUMENTS 1,640,270 A * 8/1927 Furman ..... 244/143
2,639,432 A * 5/1953 Kaplan ..... 2/128
3,266,070 A * 8/1966 O'Link ..... 441/112
3,495,274 A * 2/1970 Isaacs ..... 2/96
3,921,944 A * 11/1975 Morrison ..... 244/138 R
4,181,993 A * 1/1980 McDaniel ..... 441/108
5,072,455 A * 12/1991 St. Ours ..... 2/81
5,302,806 A * 4/1994 Simmons et al. ..... 219/211
5,603,648 A * 2/1997 Kea ..... 441/106
5,799,329 A * 9/1998 Hauschild ..... 2/102
5,867,843 A * 2/1999 Robello et al. ..... 4/246.1
6,004,177 A * 12/1999 Biesecker et al. ..... 441/92
6,589,088 B1 * 7/2003 Maness ..... 441/106
6,666,622 B1 * 12/2003 Courtney et al. ..... 405/186
6,864,858 B1 * 3/2005 Miller et al. ..... 343/915
7,013,489 B1 * 3/2006 McGrath ..... 2/69
7,370,370 B2 * 5/2008 Colombo ..... 2/69

* cited by examiner

*Primary Examiner* — Tejash Patel
(74) *Attorney, Agent, or Firm* — Ladas & Parry LLP

(57) ABSTRACT

An emergency anti-hypothermia system has a thermally insulating vest that is sufficiently portable to be carried for emergency use in a pocket, purse, backpack, compartment of a vehicle, ski pole or other location. The vest provides thermal insulation by being made with thermally insulating air impervious material that also provides for its inflation. The inflating air also provides insulation as, preferably, does thermal radiation reflective material on inwardly facing surfaces of the vest, preferably inwardly facing surfaces of outer layers of inflated chambers about the vest, the multiplicity of the chambers about the vest reducing convection heat transfer therewithin. The vest thus preferably provides thermal insulation by anti-conduction, anti-radiation and anti-convection in a highly portable system.

13 Claims, 3 Drawing Sheets

EMERGENCY ANTI-HYPOTHERMIA SYSTEM AND HIGHLY PORTABLE, INFLATABLE EMERGENCY VEST THEREFOR

This application claims the benefit of U.S. Provisional Application 60/547,918 filed Feb. 26, 2004 and incorporates the same by reference.

BACKGROUND OF THE INVENTION

Every winter, drivers get stuck on roads, run the engines of their vehicles until they run out of gas or other vehicle fuel, and then are hurt by hypothermia while they wait for assistance at a location to which they have not brought sufficiently insulating clothing. Skiiers may similarly dress for a short run, but fall or become caught by unexpected conditions that lead to exposure to cold sufficient to produce hypothermia. Still others may find themselves in such conditions with insufficient clothing insulation.

An emergency anti-hypothermia system for such conditions provides a thermally insulating vest that is sufficiently portable to be carried for emergency use in a pocket, purse, ski pole or other such location and, thereby, also in a backpack or compartment of a vehicle. A high degree of portability is desirable for such sufficient portability.

For this system, an inflatable vest is provided. The vest provides thermal insulation by being made with air impervious material that also provides for its inflation. The inflating air also provides insulation as, preferably, does thermal radiation reflective material on inwardly facing surfaces of the vest, preferably inwardly facing surfaces of outer layers of inflated chambers or cells about the vest, the multiplicity of the chambers about the vest reducing convection heat transfer therewithin. The vest thus preferably provides thermal insulation by anti-conduction, anti-radiation and anti-convection in a highly portable system.

The thermal insulation is achieved with high portability by inflation. The portability achieved by inflation is preferably augmented by thin material.

BRIEF DESCRIPTION OF THE DRAWING

Preferred embodiments will now be described with respect to a drawing that illustrates but does not limit the invention, and in which.

DESCRIPTION OF PREFERRED EMBODIMENTS

A highly portable, inflatable emergency vest is preferably made from a high tensile-strength polyester film, similar to the aluminized Mylar® used in novelty balloons (which aren't actually Mylar, but rather nylon sheet, coated on one side with polyethylene and metalized on the other). The material is electrically resistant, chemically stable, noncombustible (94VTM-2), and comes in thicknesses ranging from 0.001" to 0.014". It's a thermoplastic polymer, and is thermally and ultrasonically fusible.

Figure 1:
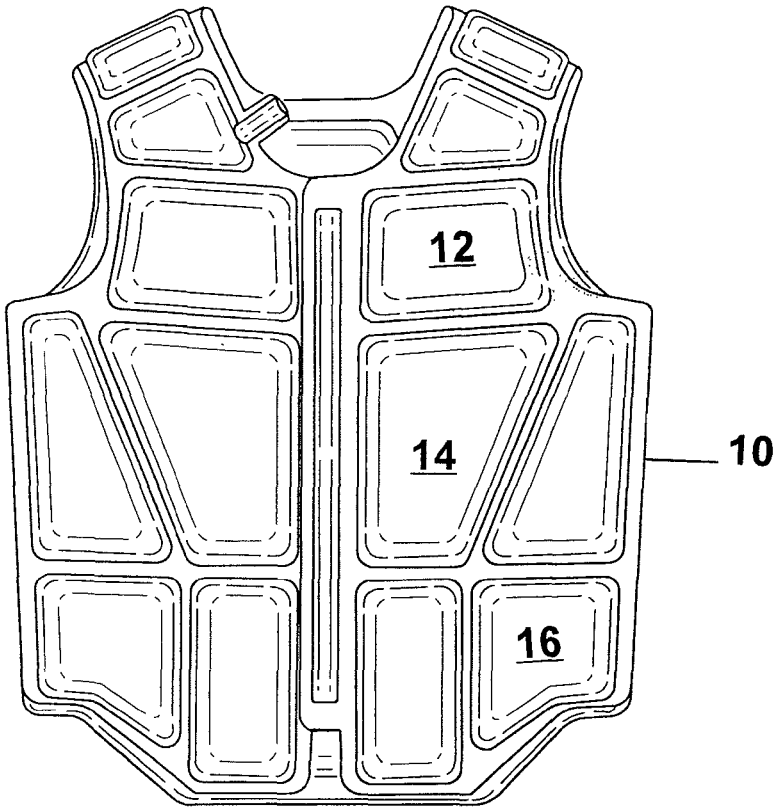
FIG. 1 is a front elevational view of a preferred embodiment in a wearable, inflated condition.
Figure 4:
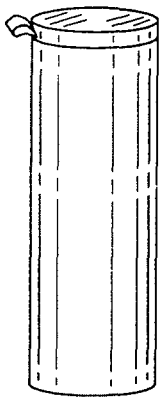
FIG. 4 is a container for the preferred embodiment in a folded deflated condition.
Figure 2:
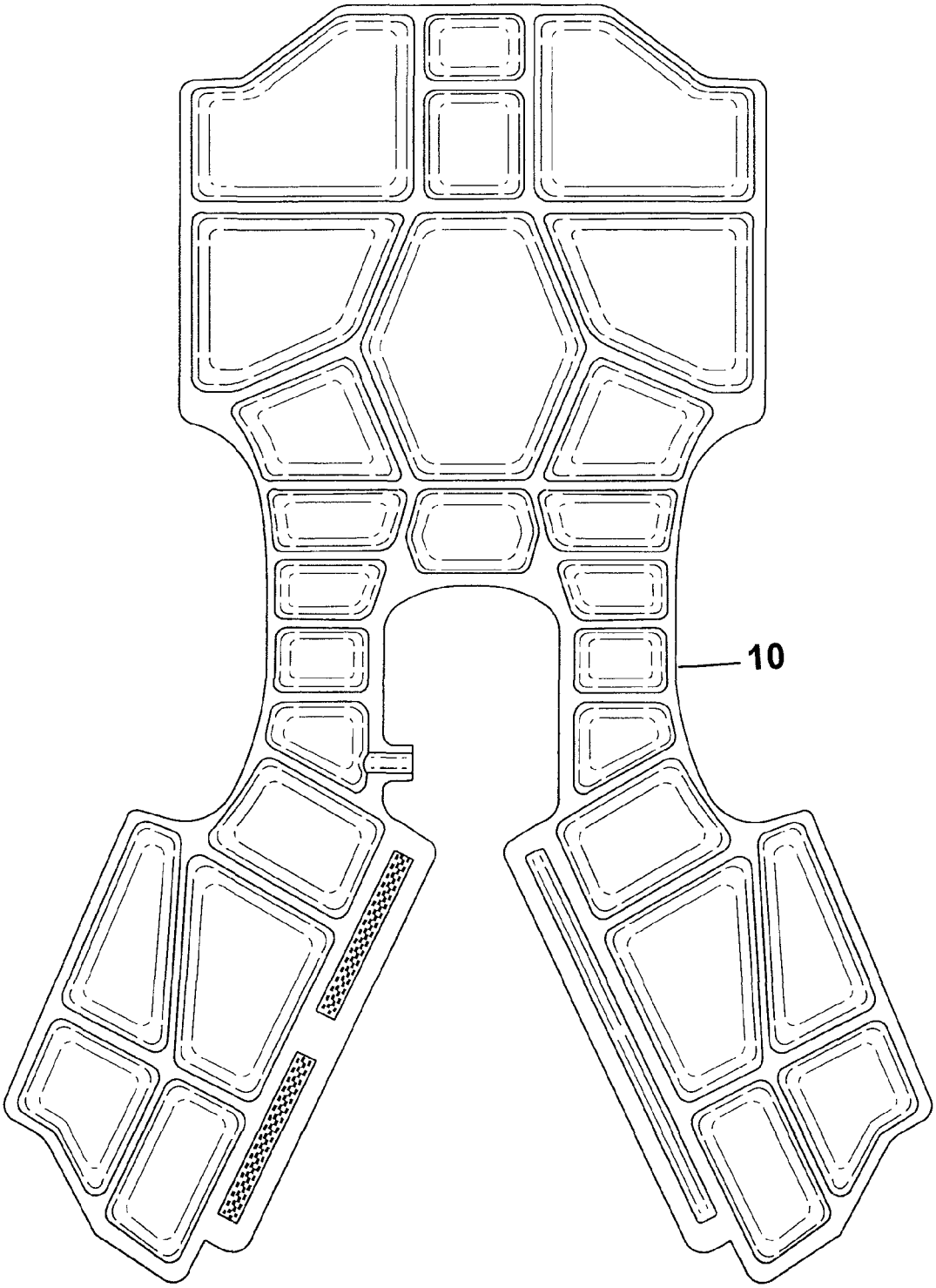
FIG. 2 is a top plan view of the preferred embodiment of FIG. 1 in a flat condition.
Figure 3:
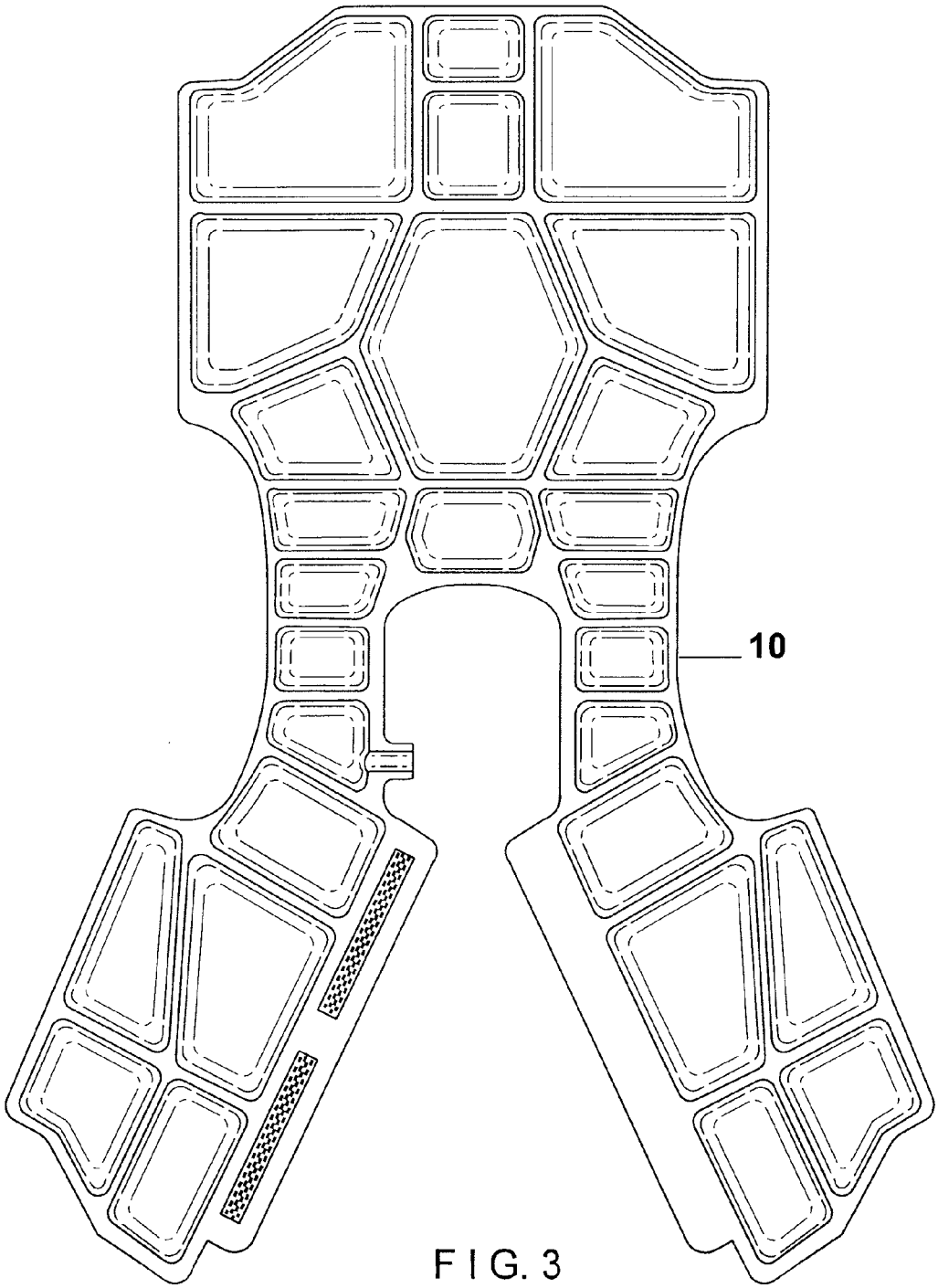
FIG. 3 is a bottom plan view of the preferred embodiment of FIG. 2.

As shown in FIGS. 1-3, a vest garment 10 has cells 12, including upper and lower cells 14, 16 in a front of the vest that are cross-connected and inflated through a simple one-way mouthpiece, for example a flap valve, for example of the film material of the vest on the garment's collar. Inflating the vest creates a layer of trapped, still air in much the same way as goose down, while conforming to the shape of the wearer—insulating the wearer's body core while allowing moist air to circulate through the shoulders and arm holes. The outside layer is offset printed using traditional methods and can be any color or design one desires, while the inside is nearly 100% reflective, preventing most radiant heat loss.

The manufacturing process looks very much like printing, and I suspect we'll need 3 sizes. The only additional line work required is the attachment of the adhesive strip on the vest's storm flap, and roll and insertion into a container, for example a box or, preferably, tube container. The container is small, because of the material and valve of the vest, preferably like the plastic, self-lidded can of M&M Mini's, e.g. a tube about 5-6 in. long by 1-1.5 in. in diameter. Just compare a handful of those to a stack of Red Cross blankets.

The vest is made from a high tensile-strength polyester film or composed of thermoplastic polymers, and is thermally and ultrasonically fusible. The material is electrically resistant, chemically stable, noncombustible (94VTM-2), and is available in thicknesses ranging from 0.001" to 0.014", and in colors from matte to metalized.

The cells in the vest are cross-connected and inflated trough a dimple one-way mouthpiece on the garment's collar. Inflating the vest creates a layer of trapped, still air in much the same way as goose down, while conforming to the shape of the wearer—insulating the wearer's body core while allowing air to escape from the shoulders. The outside layer is offset printed in any color or design, while the inside is nearly 100% reflective, preventing as much as 80% of radiant heat loss.

Steps may be:

Polyester film is 4-color printed, using a conventional offset process and re-rolled back onto spools. The printed roll is fused to the unprinted metalized film with either heat stamping (preferable), or a suitable bonding agent;

The fused master roll is registered and die-cut, producing individual vests which are now ready to final finishing;

The left and right-front panels are simply folded over to the front to bring the side-seams together.

The side-seams are either thermally or ultrasonically welded joining back to front, making sure to lap the flap from the front of the vest over the back;

The tape closure for the vest is mounted to the garment's storm flap, leaving the protective covering on the outside tape surface;

The one-way valve is glued into the vest's inflation stem. Care should be sued to ensure that this seal is air-tight;

All other steps completed, the vest is folded, rolled and inserted in its blow-molded polyethylene tube container.

The Human Factors

The biggest danger posed to an exposed individual is hypothermia. This is true at a Red Cross station, huddled with other survivors after a natural disaster, or simply changing a tire on a roadside in winter night.

Hypothermia is defined as the unintentional lowering of the deep body (core) temperature below 95.0° F. (35.0° C.). Hypothermia can be mild, moderate, or severe. During 1979-1998, approximately 700 persons died annually in the United States from hypothermia, with approximately half of these deaths attributed to extremely cold weather.

Since 1999, CDC's National Center for Health Statistics (NCHS) has used information from death certificates categorized with International Classification of Diseases codes to estimate national mortality trends. During 1999, exposure to excessive natural cold (ICD-10 code X31) was listed as the underlying cause of death for 598 persons in the United States, and hypothermia (ICD-10 code T68) was listed as a nature of injury in 1,139 deaths. Of the 598 hypothermia-related deaths, 380 (64%) occurred among males, and 359 (60%) of the 597 persons who died of hypothermia and whose age was known were aged>65 years. During 1999, Pennsylvania and New York had the greatest number of hypothermia-related deaths (36 each) (2), and Alaska had the highest crude death rate (1.9 per 100,000 population), approximately twice that of Montana, which had second-highest rate (0.9).

Hypothermia during cold weather is the result of decreased heat production, increased heat loss, or impaired thermoregulation. Older persons, who have a decreased basal metabolic rate, might be at further risk for hypothermia because of impaired physical exertion, which produces heat to keep the body warm. Inactivity limits heat production through physical exertion, but overexertion can increase evaporation from the respiratory tract and cause fatigue. Shivering also can cause enough lactate generation eventually to produce acidosis and fatigue. Exposure to high winds can further increase heat loss. As body temperature decreases, the hypothalamus fails to compensate body temperature, and the central nervous system follows the progressive systemic depression of metabolism. Finally, metabolic impairment from alcoholism, malnutrition, hypothyroidism, or advanced age can cause poor endurance to cold.

Hypothermia-related morbidity is not exclusive to cold northern climates either. Hypothermia can occur in cold and warm climates alike. In fact, a survey of 12 medical centers found that the greatest number of cases of accidental hypothermia occurred in warmer states. Hypothermia has been reported in tropical countries as well. Persons from regions with warmer winters might be at greater risk from the indirect effects of cold weather than persons from regions with colder and longer winters. However, geographic distributions might represent not only seasonal temperature variations but also socioeconomic status (which can limit access to controlled indoor temperature), cultural backgrounds (which can influence behavior toward individual protection from cold as well as outdoor activity), or populations with a higher proportion of elderly persons.

Additional Applications

For safety/visibility applications, I'm planning to use 3M's Series 8000 reflective ink for textiles, instead of the bulky Scotchlite reflective strips. The Inks are composed of a water-based (latex) ink base combined with the familiar retro-reflective microlenses. This process is used for direct screen printing onto fabric or plastics, and the end result with respect to visibility is the same. 3M also makes a stabilizing coating, but since this is a one-use item, it's hardly necessary for this application. I may just choose to use another medium like PolySol, instead of the latex base if I need greater adhesion stability. I also need to learn a bit more about ANSI Class II certification before I finalize the placement of the reflectors. It should be noted that in this application, unless the vest is sealed in front and/or inflated, it can be used again and again.

The Market

Naturally, there's retail sales to individuals (perhaps bundled in branded, home and car emergency kits), but I think there's a much larger market as a custom-printed OEM product to automobile manufacturers, airlines, commercial transportation networks, national parks, sports stadiums and other outdoor entertainment venues; as well as emergency-response and relief organizations like the Red Cross, FEMA, The United Nations, U.S. and international police and fire services, EMS, hospitals, military, etc. It's a virtually endless list.

Combinations, permutations and variations as will occur to those of ordinary skill are contemplated within the scope of the following claims.

The invention claimed is:

1. In a vest of an emergency anti-hypothermia system, the improvements wherein at least part of the vest is inflatable and the vest is thermally insulating around closeable sides, a substantially full front of the vest, and a substantially full back of the vest from a neck area to a waist area of the vest, wherein the vest has thermal radiation reflective material on at least one surface of the vest that is inwardly facing when the vest is worn.

2. The vest according to claim 1, wherein the vest is made with air impervious material, whereby to provide the part that is inflatable.

3. The vest according to claim 1, wherein the part of the vest that is inflatable comprises chambers.

4. The vest according to claim 2, wherein the part of the vest that is inflatable comprises chambers.

5. The vest according to claim 1, wherein the surface that is inwardly facing is on the outside of the chambers.

6. The vest according to claim 2, wherein the vest is sufficiently portable and is sufficient for insertion into a tube less than 6 inches long by no more than 1.5 inches in diameter.

7. The vest according to claim 6, wherein the material of the vest has a thickness no more than 0.014 inches.

8. In an emergency anti-hypothermia system comprising a vest, the improvements wherein:

the vest is comprised of a thermally insulating garment around closeable sides, a substantially full front of the vest, and a substantially full back of the vest from a neck area to a waist area of the vest, and wherein the vest is sufficiently portable to be carried for emergency use;

at least part of the garment is inflatable and of an air impervious material;

the part that is inflatable comprises chambers defined by surfaces; and radiation reflective material is on only an outer one of the surfaces that is inwardly facing when the garment is worn.

9. The vest according to claim 2, further comprising a tape on one of a front or back of the vest when the vest is worn for closing the vest, the tape having a protective covering on an outside surface of the tape.

10. In a vest, of an emergency anti-hypothermia system, the improvements wherein at least part of the vest is inflatable and the vest is thermally insulating around closeable sides, a substantially full front of the vest, and a substantially full back of the vest from a neck area to a waist area of the vest, wherein the part of the vest that is inflatable comprises chambers, and wherein the chambers are upper and lower on at least a front of the vest and cross-connected.

11. The vest according to claim 10, wherein the vest is made with air impervious material, whereby to provide the part that is inflatable.

12. The vest according to claim 8, further comprising a tape on one of a front or back of the vest when the vest is worn for closing the vest, the tape having a protective covering on an outside surface of the tape.

13. The vest according to claim 10, further comprising a tape on one of a front or back of the vest when the vest is worn for closing the vest, the tape having a protective covering on an outside surface of the tape.

* * * * *